US006717117B2

(12) United States Patent
Blanchard et al.

(10) Patent No.: US 6,717,117 B2
(45) Date of Patent: Apr. 6, 2004

(54) METHODS AND SYSTEMS FOR COOKTOP CONTROL

(75) Inventors: Cecilia Maria Blanchard, Louisville, KY (US); Scott A. Horning, Louisville, KY (US); Michael Paul McGonagle, Louisville, KY (US); Jeffrey Alan Kern, Louisville, KY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/015,149

(22) Filed: Oct. 25, 2001

(65) Prior Publication Data

US 2003/0080111 A1 May 1, 2003

(51) Int. Cl.[7] ..... H05B 1/02

(52) U.S. Cl. ..... 219/492; 219/497; 219/412; 219/448.1; 374/1

(58) Field of Search ..... 219/494, 497, 219/499, 448.1, 481, 492, 483–486; 374/1, 101, 102, 120

(56) References Cited

U.S. PATENT DOCUMENTS

| | | | | |
|---|---|---|---|---|
| 4,443,690 A | | 4/1984 | Payne et al. | |
| 4,465,228 A | | 8/1984 | Mori et al. | |
| 4,714,822 A | | 12/1987 | Braun et al. | |
| 4,737,617 A | | 4/1988 | Payne | |
| 4,816,647 A | | 3/1989 | Payne | |
| 4,859,834 A | * | 8/1989 | Hausler et al. | 219/497 |
| 4,983,811 A | * | 1/1991 | Oppor et al. | 219/497 |
| 5,125,068 A | | 6/1992 | McNair et al. | |
| 5,228,114 A | * | 7/1993 | Suzuki | 219/494 |
| 5,353,781 A | | 10/1994 | Calvillo | |
| 5,880,438 A | * | 3/1999 | Parrini et al. | 219/519 |
| 6,018,150 A | | 1/2000 | Maher, Jr. | |
| 6,118,104 A | | 9/2000 | Berkcan et al. | |
| 6,118,105 A | | 9/2000 | Berkcan et al. | |
| 6,246,033 B1 | | 6/2001 | Shah | |
| 6,337,468 B1 | * | 1/2002 | Worthington et al. | 210/497 |

* cited by examiner

*Primary Examiner*—M H Paschall
(74) *Attorney, Agent, or Firm*—H. Neil Houser, Esq.; Armstrong Teasdale LLP

(57) ABSTRACT

A cooktop comprising at least one cooktop heater and a controller coupled to the heater and operable to control operation of the heater, including cool down of the heater and drift detection, is described. In one embodiment, the cooktop further comprises a control interface coupled to the controller. The interface comprises a power setting selection unit for operator selection of a power level setting for the heater. The controller is configured to switch off supply of power to the heater if a second power level selection for the heater is a lower power level than a first power level selection, and to then resume standard heater operation once a temperature corresponding to the second power level selection is reached.

24 Claims, 7 Drawing Sheets

METHODS AND SYSTEMS FOR COOKTOP CONTROL

BACKGROUND OF THE INVENTION

This invention relates generally to cooktops and more particularly, to controlling operation of a cooktop based on cooktop temperature.

The term cooktop as, used herein refers to a cooking system that comprises at least one electric heating element or heater. A cooktop system can be a stand-alone unit that is mounted, for example, on a kitchen countertop. A cooktop system also can be integrated with an oven to form a range. Ranges including cooktop systems and stand alone cooktop systems are commercially available from the GE Appliances business, Louisville, Ky., of General Electric Company.

Cooktop systems typically have a generally planar glass-ceramic cooking surface with heating units located just below the cooking surface. Each heating unit, or heater, is operable at various power levels. Prior to operation, a user typically positions a pot or pan containing food on the glass cooking surface over a heater to be operated and selects, via a user interface, a desired power level for the heating element. The cooktop system responds by supplying power to the selected heating element in accordance with the user selected power level. For example, for a lower power level setting (e.g., a power level setting of 1), the heater is energized, or "on", for a shorter period of time of each duty cycle as compared to the period of time which the heater is "on" for each duty cycle at a higher power level setting. Examples of such operation are set forth in U.S. Pat. Nos. 4,816,647 and 4,443,690, which are assigned to the present assignee.

To preserve the life of the glass cooktop, operation of each heater typically is limited to not exceed a preset temperature. For example, with one particular glass cooktop, the temperature of the glass cooking portion of the cooktop is monitored to avoid heating the glass cooking portion to or above 560° C. Temperature monitoring is performed by respective resistive temperature devices (RTDs) positioned so that each RTD exhibits a resistance related to the temperature of the cooktop at each heater. If any one RTD exhibits a resistance representative of a temperature at or above 560° C., then the associated heater is de-energized or operated at a power level below the selected power level so that the cooktop cools.

Over time, the RTDs and other components associated with heater control may "drift". The term "drift", as used herein, refers to a condition in which a determined temperature varies from an actual temperature. Drift can be caused by many different factors, including component degradation or corrosion. For example, an RTD which has not degraded may exhibit a resistance of 1 k ohm at a temperature limit of 560° C., whereas an RTD which has degraded may exhibit a resistance of 900 ohms at the same actual temperature. As a result, and rather than limiting operation of the heater to 560° C., the degraded RTD may allow operation of the heater to temperatures in excess of 560° C. Such drift is not limited to being caused by degradation of an RTD, and can be caused by many different factors.

In another example, the determined temperature may be 560° C. when the actual temperature is much lower, e.g., 400° C. In such circumstances, the associated heater will be energized, or operated at a lower power level than the user selected power level. Cooking, therefore, may proceed much slower than desired.

In addition, and during operation, a user may change the power level setting to a higher or lower power level than the initial power level setting. For example, a higher power level setting may be desired if cooking is not proceeding as quickly as desired. Similarly, a lower power level setting may be desired if cooking is proceeding too quickly or if an overflow event is imminent. Rapid response by the cooktop system to user initiated changes in power level enhances customer satisfaction with such system.

Although the energization of the heater is immediately altered to correspond to a lower power level upon user selection of such lower power level, due to thermal inertia of the load (i.e., the pot or pan, the food in the pot or pan, and the glass cooktop), the temperature of the load does not immediately decrease to the temperature corresponding to the lower power level. Rather, the temperature of the load gradually decreases to a temperature corresponding to the lower power level setting. More rapidly decreasing the temperature of the load under such conditions would facilitate cooking food more closely in accordance with user preferences.

One known algorithm for operating a cooktop heating element in a fast cool mode is described in U.S. Pat. No. 4,443,690. As explained in the subject patent, a signal representing a power setting lower than the actually selected setting is substituted for the signal representing the selected setting for the duration of the fast cool mode. As further explained in the subject patent, an energy counter is utilized to determine whether the fast cool mode should be implemented based on certain operating conditions. Providing simplified and uncomplicated methods and systems for rapidly cooling a heater, in comparison to the method and system described in U.S. Pat. No. 4,443,690 which involve an energy counter and multiple thresholds, would facilitate implementation of fast cool down operation.

BRIEF SUMMARY OF THE INVENTION

In one aspect, a cooktop system comprising at least one cooktop heater and a controller coupled to the heater and operable to control supply of power to the heater is provided. The cooktop system further comprises a control interface coupled to the controller. The interface comprises a selection unit for operator selection of a power level setting for the heater. The controller is configured to switch off supply of power to the heater if a second power level selection for the heater is a lower power level than a first power level selection. In the example embodiment, the controller is further operable to detect drift.

In another aspect, a method for controlling operation of a cooktop heater is provided. The method, in one example, comprises the steps of supplying power to the heater in accordance with a first power level selection, and upon receipt of a command to reduce the power level from the first power level selection to a second power level selection, switching off supply of power to the heater. In another example, the method includes the step of detecting drift.

In yet another aspect, a controller for coupling to a heater of a cooktop is provided. The controller comprises a processor operable to switch on supply of power to the heater upon receipt of a first command to energize the heater according to a first power level selection, and switch off supply of power to the heater upon receipt of a second command to energize the heater according to a second power level selection. The controller also, in the example embodiment, is operable to detect drift.

DETAILED DESCRIPTION OF THE INVENTION

Methods and systems for controlling cooktop heaters are described below. Such methods and systems are described in the context of a particular electric cooktop configuration. Such methods and systems, however, are not limited to practice with one particular cooktop and can be used in connection with many different cooktop configurations. For example, the methods and system can be practiced in connection with stand alone cooktops as well as with cooktops incorporated into ranges. Therefore, the following description regarding a particular cooktop is by way of an example only.

Figure 1:
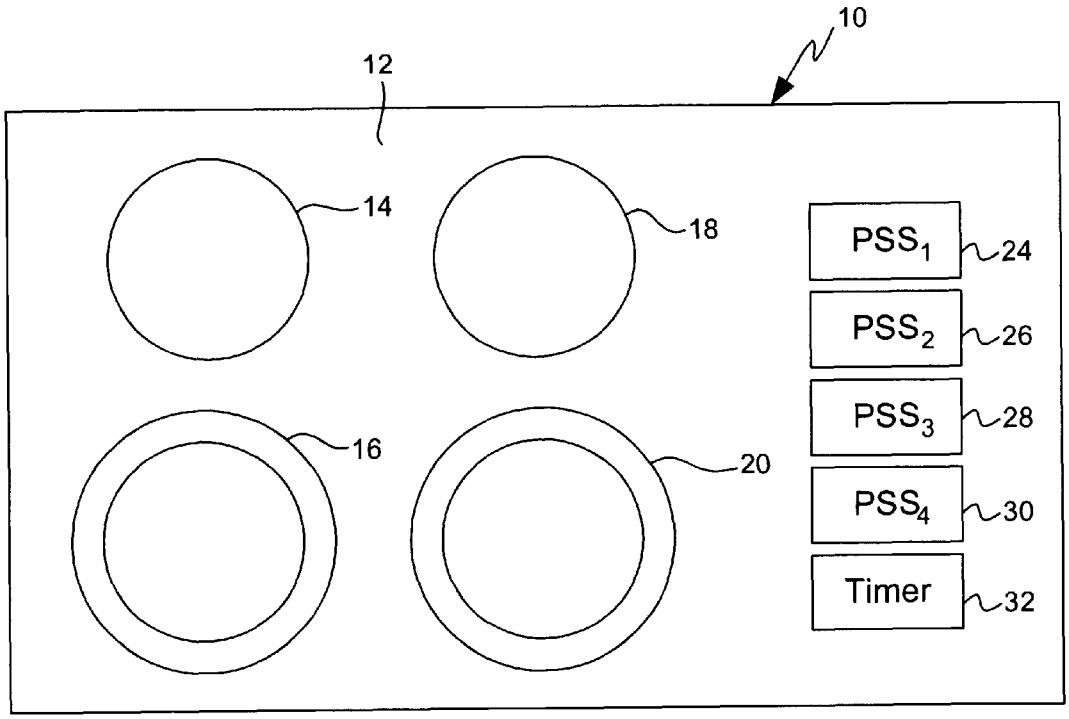
FIG. 1 is a top plan view of an example cooktop system.

Referring now specifically to the drawings, FIG. 1 is a top plan view of an example cooktop system 10. System 10 has a generally planar glass-ceramic cooking surface 12. Circular patterns 14, 16, 18, and 20 identify relative lateral positions of each of four heating units (not shown) located directly underneath surface 12.

System 10 further includes a control interface 22 that comprises power setting selection ($PSS_1$–$PSS_4$) units 24, 26, 28, and 30 and a timer unit 32. Each power setting selection unit 24, 26, 28, and 30 corresponds to one of the heating units, and a user selects a power level for a respective heating unit via the corresponding selection unit 24, 26, 28, and 30. Timer unit 32 provides a convenience to a user of being able to measure time. Units 24, 26, 28, 30, and 32 each include, for example, touch sensitive keys for facilitating user input of desired power levels and a timer setting.

Regarding the power level settings that may be selected by a user, and in an example embodiment, a user can select one of eleven power level settings. Specifically, a user can select one of the following power settings: L (low), 1, 2, 3, 4, 5, 6, 7, 8, 9, and H (high). Each power level setting roughly corresponds to a cooktop temperature. The correspondence between power level and cooktop temperature is rough in that temperature varies depending on the load, i.e., the food being cooked and the container in which the food is contained. The temperature also depends on the heater type and size, and the specific control used to energize the heater.

A temperature for a defined load can be empirically generated for each heater and for each power level setting. For example, for the burner located under circular pattern 14, a table can be generated empirically for an average or typical load in accordance with the following.

| Power Level Setting | Temperature |
|---|---|
| L | $T_1$ |
| 1 | $T_2$ |
| 2 | $T_3$ |
| 3 | $T_4$ |
| 4 | $T_5$ |
| 5 | $T_6$ |
| 6 | $T_7$ |
| 7 | $T_8$ |
| 8 | $T_9$ |
| 9 | $T_{10}$ |
| H | $T_{11}$ |

Each heater is associated with a temperature sensor. The temperature sensor is positioned to generate a signal representative of the temperature of the glass within one of respective circular patterns 14, 16, 18, and 20. Such temperature sensing is known in the art, and an example temperature sensor configuration is described in U.S. Pat. No. 4,816,647.

Figure 2:
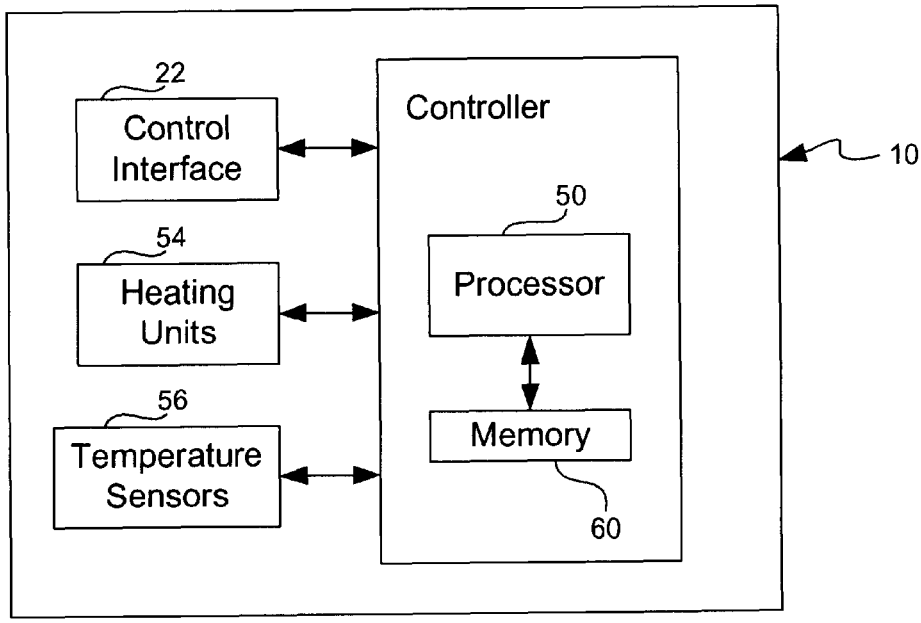
FIG. 2 is a block diagram of an example cooktop system.

FIG. 2 is a block diagram of cooktop system 10. Cooktop system 10 includes a controller 50 coupled to control interface 22, heating units 54, and temperature sensors 56. Controller 50 includes a processor 58 and a memory 60 for storing data and operational parameters for heating units 54. In response to user manipulation of control interface 22, controller 50 executes routines and activates features selected by the user.

In addition, and in the example embodiment, the empirically determined temperatures for each heater at each power level setting are stored in memory 60. These temperatures are utilized as described below in more detail.

FIGS. 3–6 illustrate an example method for detecting drift. The method, in the example embodiment, is executed by processor 58 operating under control of a program stored in memory 60. The methods illustrated in FIGS. 4–6 can be utilized in connection with performing certain steps illustrated in FIG. 3, as described below in more detail.

Figure 3:
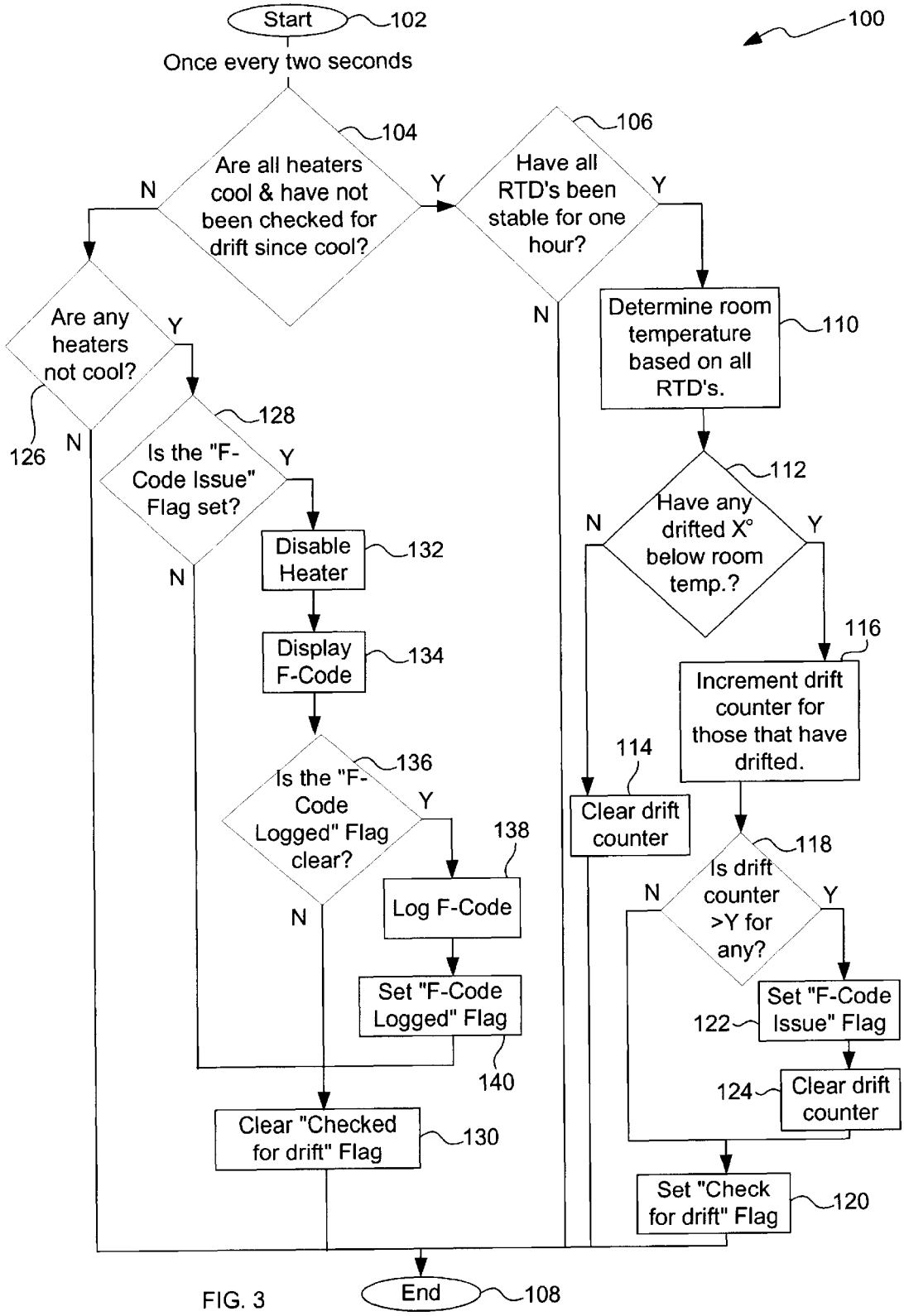
FIG. 3 is a flow chart illustrating an example drift detection method.

FIG. 3 is an example embodiment of a method 100 for determining whether drift has occurred, controlling operation of the cooktop upon determining drift has occurred, and displaying a failure code (F-Code) in the event that drift does occur. Generally, after any one or more of the heaters have been energized and then subsequently turned off, and once the heaters are cool (i.e., once the "hot surface" lights are off) and have been stable for a preselected period of time (e.g., one hour), the method includes the steps of determining a room temperature (e.g., using the RTD values) and then checking for drift using the determined room temperature (e.g., the RTD value for each RTD is compared to the determined room temperature). If drift is detected as a result of such comparison, then an "F-Code Issue" flag is set for the heater associated with the detected drift. Upon completing the check for drift, a "Check for drift" flag is set so that drift is checked for only once after the heaters are stable for the preselected period of time.

When a user subsequently uses the cooktop (i.e., once any one or more heaters are energized and no longer cool), then the cooktop processor checks whether any "F-Code Issue" flags are set. If an "F-Code Issue" flag is set, then the associated heater is disabled, i.e., not energized, and an F-Code is displayed to the user to alert the user to a need to have the cooktop serviced. In addition, the issuance (or display) of the F-Code is stored into a portion of the processor memory designated as an F-Code log. The log is accessible for later reference by a service representative. The "Checked for drift" flag is then cleared so that drift is once again checked for after the heaters are cool (i.e., once the "hot surface" lights are off) and have been stable for the preselected period of time.

Referring now specifically to FIG. 3, and more particularly, after a cooking operation processor 58 initiates 102 drift detection method 100. To determine whether the cooktop is off and whether a drift check should be performed, processor 58 determines whether all the heaters are cool (e.g., whether the "hot surface" lights have been turned "off") and whether all the heaters have been checked for drift since becoming cool 104. Specifically, once every two seconds, processor 58 determines whether all heaters are cool and have not been checked for drift since cool 104.

If all of the heaters are cool and if drift has not been checked for since the heaters became cool 104, then processor 58 determines whether all the temperature sensors (in the example embodiment, resistive temperature device) have been stable for a preselected period of time, e.g., one hour, 106. Methods for determining whether the RTDs have been stable for a preselected period of time are described below in connection with FIGS. 4 and 5.

Still referring to FIG. 3, if the RTDs have not been stable for the preselected period of time, then processing ends 108. If the RTDs have been stable for such time, then processor 58 determines the room temperature based on readings from the RTDs 110. A method for determining the room temperature based on readings from the RTDs is described below in connection with FIG. 6.

Once the room temperature has been determined 110, then processor 58 determines whether any of the RTDs (or associated RTD circuit components) have drifted a preselected number of degrees (X°) below the room temperature 112. If no, then processing proceeds by processor 58 clearing the drift counters 114. If yes, then a respective drift counter for the associated RTD is incremented 116. More specifically, a drift counter is associated with each RTD and each counter counts the number of drift events for a respective RTD.

If the drift counter value for any respective RTD is less than or equal to a value greater than a preselected value Y 118, processing proceeds to set the "Checked for drift" flag 120. In an example embodiment, the preselected value Y is equal to 5. Therefore, in the example embodiment, if 5 or fewer drift events have been counted and not cleared for a particular RTD, then the failure code is not issued. Requiring a preselected number of drift events to occur before issuing a failure code facilitates preventing nuisance responses, e.g., issuing a failure code prematurely. For example, a drift event can be caused if a cool food item happens to be placed on the cooktop at the same time drift is being checked. The RTD may actually drift under such circumstances but such drift is not necessarily cause for issuing a failure code. The likelihood that a cool food item will be placed on the same cooktop location six consecutive times while checking for drift is not highly likely.

If the drift counter value is greater than the preselected value Y 118, then the "F-Code Issue" flag is set 122 and the drift counter is cleared 124. Processing then proceeds with processor 58 setting the "Checked for drift" flag 120, and processing ends 108.

If a cooking operation is initiated after a drift check has been performed, then once a heater is energized, processor 58 checks to determine whether any failure codes have been issued and if there is an issued failure code, processor 58 disables the associated heater. More particularly, after checking for drift and setting the "Checked for drift" flag 120, processor 58 returns to initiate drift check and control 102. Since the drift flag is now set, processor 58 determines that drift has been checked for 104 and proceeds to determine whether any heaters are not cool 126. That is, once the "Checked for drift" flag is set, processor 58 does not continually check for drift. Rather, processor 58 proceeds to determine whether cooking has been initiated by determining whether any heater is not cool 126. If all the heaters are cool, processing ends 108 and the check for initiation of cooking is repeated.

If any heater is not cool, i.e., cooking has been initiated, then processor checks whether an "F-Code Issue" flag is set 128. If the "T-Code Issue" flag is not set, then the "Checked for drift" flag is cleared 130. Clearing the "Checked for drift" flag enables a subsequent check for drift to be performed when all the heaters are once again cool and stable, as described above. If the "F-Code Issue" flag is set, however, then the associated heater is disabled 132 and the F-Code is displayed 134 on the user interface. If the "F-Code Logged" flag is not clear 136, then processing proceeds to clear the "Checked for drift" flag 130. If the "F-Code Logged" flag is clear, then the F-Code is logged 138 and the "F-Code Logged" flag is set 140. Processing proceeds to clear the "Checked for drift" flag 130. Processing then ends 108.

Figure 4:
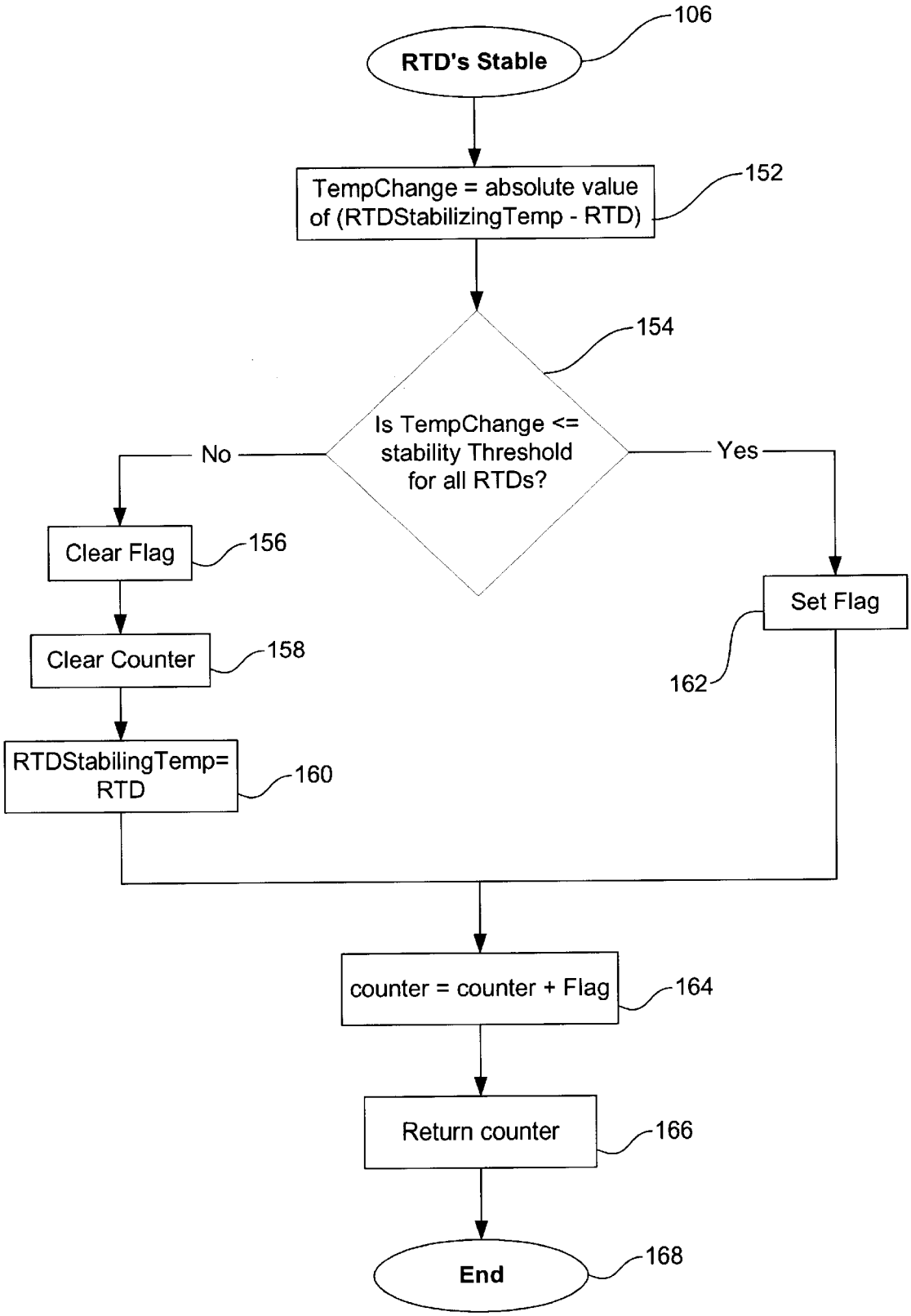
FIG. 4 is a flow chart illustrating an example method for determining whether resistive temperature devices are stable.

FIG. 4 is a flow chart illustrating an example method for determining whether all the RTD's are stable 106. Generally, an RTD is stable if the RTD value has not fallen below a stability threshold within a preselected period of time. If the RTD value has fallen below the stability threshold within the preselected period of time, then the RTD is not stable and processor 58 continues checking the RTDs that are not yet stable for stability. For example, if the RTD value at time 1 has a value of X° C. and then when checked again within a predetermined period of time t has a value of (X° C.-5° C.), then the RTD is not yet stable. If, however, the RTD has a value of X° C. and then when checked again within the predetermined period of time t still has a value of X° C., then the RTD is stable.

Specifically referring to FIG. 4, to determine whether the RTDS are stable 106, processor 58 sets TempChange equal to the absolute value of (RTDStabilizing Temp−RTD) 152, where RTDStabilizing Temp is initially set to the last RTD temperature value as explained below and RTD is the temperature value of the associated RTD. Once the value for TempChange has been set, then processor 58 determines whether TempChange is less than or equal to a stability Threshold for all RTDs 154. The stability Threshold is a preset temperature value which corresponds to representing that an RTD has remained stable since the last check. If TempChange is greater than the stability Threshold for all RTDs, then the RTD stable flag is cleared 156, the RTD stable counter is cleared 158, and RTDStabilizingTemp is set equal to the value of the RTD 160. If TempChange is less than or equal to the stability Threshold, then the stability flag is set 162.

Processing proceeds by incrementing the counter, i.e., counter=counter+Flag, 164 and returning the counter value 166. In the example embodiment, as the RTD stable routine 106 is continued to be called, the counter is either incremented until an hour has passed (i.e., the RTD has not significantly changed for an hour) or the counter is cleared because the RTD has changed. If the RTD changes, then the RTDStabilizingTemp is set equal to the RTD value to reflect the latest temperature and the counter is cleared and counting starts over. Processing then ends 168.

Figure 5:
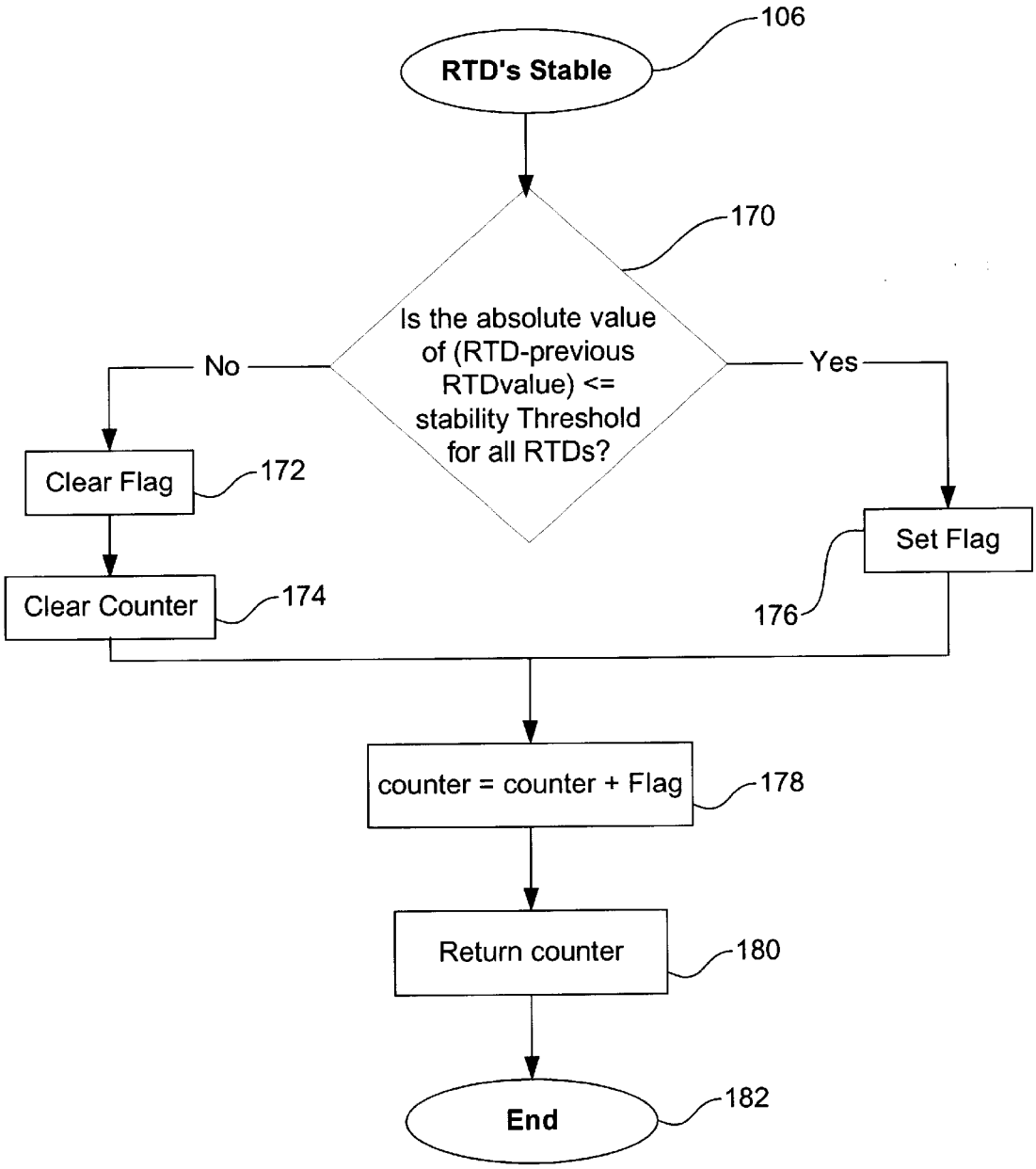
FIG. 5 is a flow chart illustrating another example method for determining whether resistive temperature devices are stable.

FIG. 5 is a flow chart illustrating another example method for determining whether all the RTD's are stable 106. Specifically referring to FIG. 5, and for each RTD, processor 58 determines whether the absolute value of (RTD–previousRTDvalue) is less than or equal to a stability threshold 170. If no, then the RTD stable flag is cleared 172 and the counter also is cleared 174. If yes, then the RTD stable flag is set 176. After clearing the counter 174 or setting the flag 176, processing continues by incrementing the counter (i.e., counter=counter+Flag) 178. The counter value is stored in memory 180, and processing to determine whether the RTDs are stable ends 182.

Figure 6:
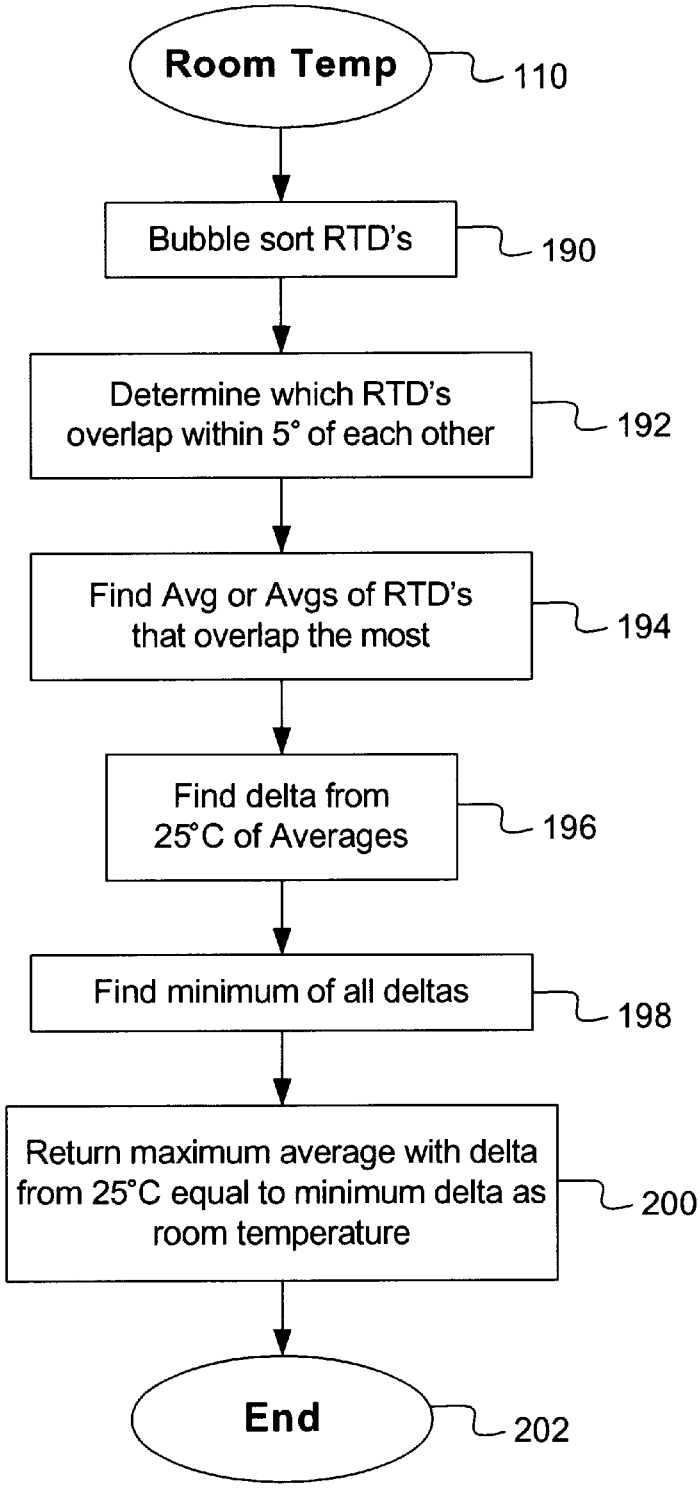
FIG. 6 is a flow chart illustrating an example method for determining a room temperature.

FIG. 6 is a flow chart for determining room temperature 110. Generally, room temperature is determined from the average values of the RTDs that are stable (as explained above) and that are within a preselected range (e.g., 5° C.) of each other. There can be separate groups of RTDs which are within the preselected range of each other, and under such circumstances, the method includes assessing the average values of respective groups and then selecting one average value of one RTD group as a determined room temperature.

More specifically, and to determine room temperature in accordance with the example method, all readings from the RTDs are bubble sorted 190 by processor 58, i.e., sorted in a table from smallest value to largest value, and then processor 58 determines which RTDs, or more specifically, the temperature values derived from the signal from each respective RTD, overlap within a preselected range, e.g., 5° C., of each other 192.

For the RTD values that overlap, i.e., are within the preselected range of 5° C. from each other, an average temperature value is determined 194. For example, if three RTD values are all within 5° C. of each other, then the average temperature value is obtained by adding the three RTD values and dividing the sum by three. In addition, and as explained above, there can be multiple overlapping groups of RTD values that are within 5° C. of each other, and under such circumstances, the average value for the largest group is determined (e.g., if a group of 2 RTDs and a group of 3 RTDs are identified, then the average value of the group of 3 RTDs is determined). If there are multiple groups having the same and the highest number of RTDs, e.g., 3, then the average value for each such group is determined.

Once the average values are determined as set forth above, then processor 58 finds the delta, or difference, from 25° C. of the averages 196. The average value which has the smallest, or minimum, delta from 25° C. is then determined 198 by comparing each of the deltas to each other. Processor 58 then selects the average value with the minimum delta from 25° C. as being equal to room temperature 200. If there are two or more groups with equal deltas, then the higher average is selected as being equal to room temperature. Processing then ends 202.

Figure 7:
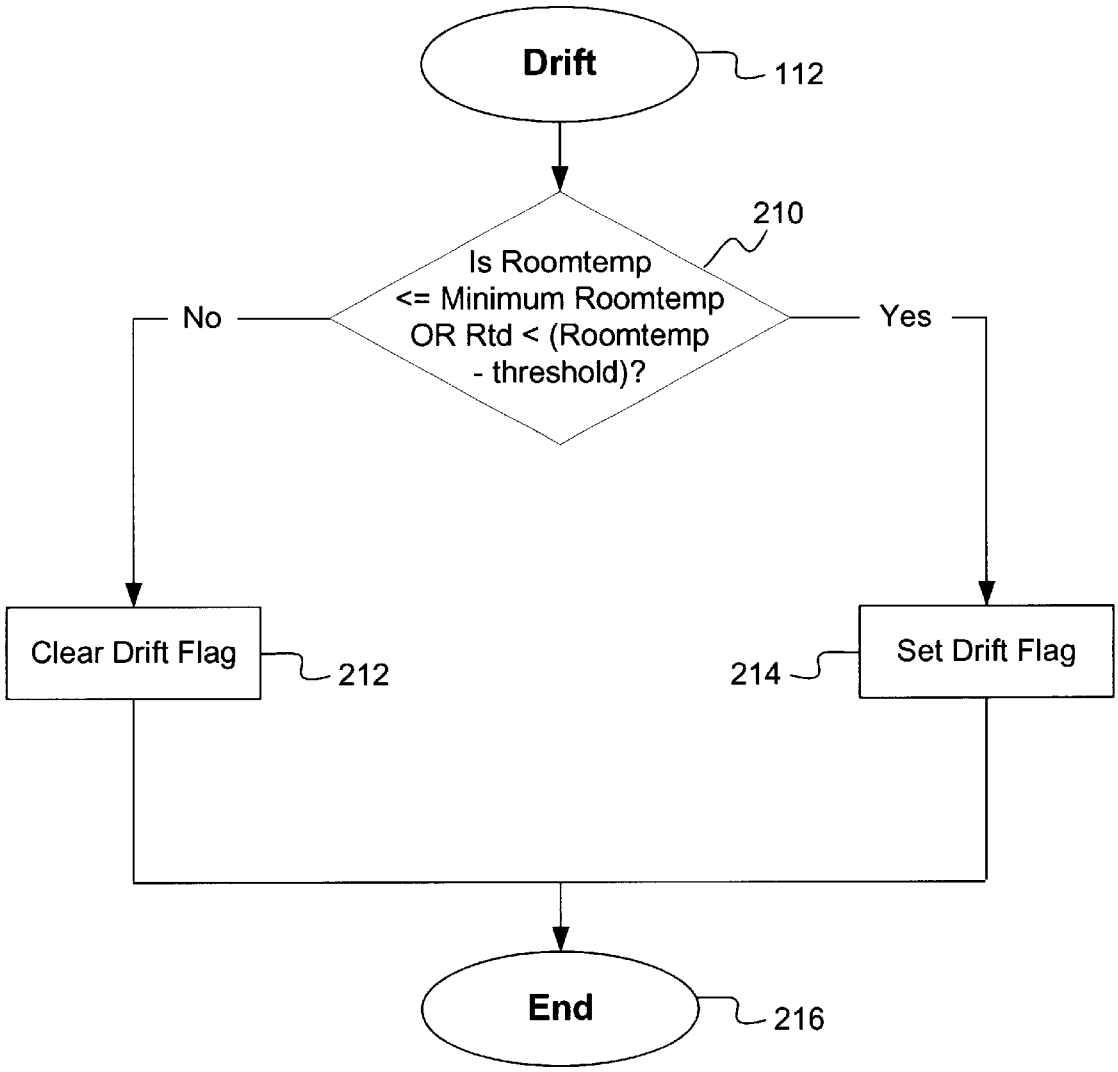
FIG. 7 is a flow chart illustrating an example method for determining whether drift has occurred.

FIG. 7 is a flow chart for determining whether drift has occurred 112. Generally, once all RTDs have stabilized at or below the room temperature value generated as explained above, if any RTD has a value less than a preselected room temperature threshold, then drift has occurred and a drift flag is set.

Specifically referring to FIG. 7, processor 58 determines whether the determined room temperature is less than a minimum room temperature, e.g., 5° C., 210. For example, if the determined Roomtemp is less than 5° C., then such a circumstance would indicate that significant drift has occurred. In addition, processor 58 determines whether an RTD value is less than the determined room temperature minus a preselected threshold 210. If the result of both determinations is no, then processor 58 clears the drift flag 212 for that particular RTD. If the result of either determination is yes, then processor 58 sets the drift flag 214. Processing then ends 216.

The temperature sensors, e.g., RTDs, can further be used to enhance the responsiveness of the cooktop to user initiated power level reductions. For example, if a user initially selects power level 9 for cooking, at some time during cooking the user may lower the power level to power level 5. Reducing the power level can be done for many different reasons, e.g., to slow cooking, to avoid a boil over.

Figure 8:
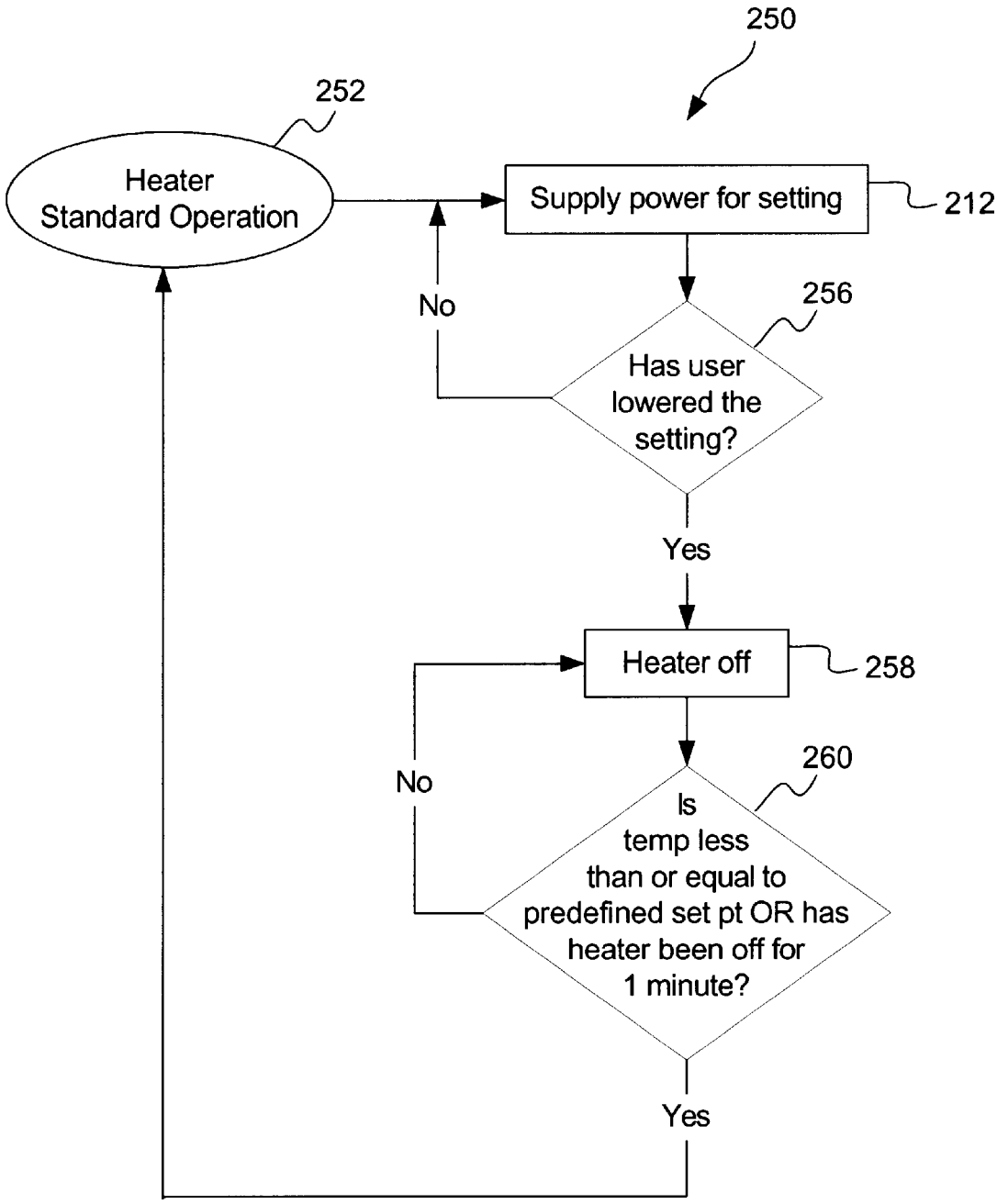
FIG. 8 is a flow chart illustrating an example cool down method.

FIG. 8 is a flow chart illustrating an example cooktop cool down method 250. In an example embodiment, the method is implemented by processor 58 operating under the control of a computer program stored in memory 60. Generally, if a user reduces a power level setting during cooking, processor 58 deenergizes the associated heater so that the temperature of the heater and load more quickly decreases to the temperature corresponding to the later selected, lower power level.

Referring specifically to FIG. 8, processor 58 ordinarily executes a standard operation algorithm 252 for controlling the cooktop heaters. That is, the cooktop heaters are normally off. Once a user makes a power level selection for a particular heater, processor 58 operates so that power is supplied 254 to the selected cooktop heater based on the user selected power level. Algorithms for controlling the supply of energy to cooktop heaters in accordance with power level settings are known and an example algorithm is described in U.S. Pat. No. 4,816,647.

If the user does not lower the power level setting 256 via user interface 22, then processor 58 continues with normal operations in supplying power to the heater in accordance with the standard operation. If the user does lower the power level setting 256 after the heater has stabilized at the initial power level setting, then processor 58 operates so that energy is not supplied to the respective heater 258, i.e., the heater is turned off. By requiring that the heater temperature stabilize at the initial power level setting, such requirement facilitates unnecessarily cycling the heater off.

As an example, if the user initially sets a heater power level to power level 3, then power is supplied to the designated heater in accordance with the power level 3 selection. If the user then subsequently changes the power level setting from power level 3 to power level 1, then processor 58 operates so that energy is not supplied to the heater. In the example embodiment, processor 58 maintains the particular heater off until the heater temperature reaches or is less than a predefined set point, e.g., for power level 1, the predefined set point is $X_1$° C. Once the heater temperature 260 is less than or equal to the predefined set point, e.g., $X_1$° C., corresponding to the selected power level or if the heater has been off for a predefined period of time, e.g., 1 minute, then processor 58 resumes standard operation 252 with respect to maintaining the heater at the temperature associated with the current user selected power level setting.

Execution of algorithm 250 is expected to result in a more rapid reduction of the temperature of the load as compared to the temperature reduction achieved with typical heater control algorithms since power is completely removed from the heater until a predefined temperature set point or a predefined period of time has elapsed. Also, limiting the period of time in which the heater will be off facilitates continuity of cooking in accordance with the user selection since if the user has not selected to turn the heater completely off, the user most likely has an expectation that some cooking will continue at the lower power level setting even during the transition from the higher to the lower power level setting.

Variations of the above described control are possible and contemplated. For example, rather than being based on a power level settings, temperature settings could be utilized. That is, a user could initially select a first temperature setting and then if the user selects a second temperature setting lower than the first temperature setting, the processor could detect the selection of the lower power setting and immediately remove power from the heater. In addition, and although the control is described above as being dependent upon the heater stabilizing at the first power level setting in order for the heater to be turned off upon selection of a second power level setting that is lower than the first power level setting, such control need not be dependent on such heater stabilization. That is, so long as the second power level setting is below the first power level setting, the heater could be de-energized, i.e., turned off, upon the operator making the second power level selection.

While the invention has been described in terms of various specific embodiments, those skilled in the art will recognize that the invention can be practiced with modification within the spirit and scope of the claims.

What is claimed is:

1. A cooktop system comprising:

a cooking surface;

at least one cooktop heater below said cooking surface;

a temperature sensor for generating a temperature signal representative of a cooktop temperature; and a controller coupled to said heater and to said temperature sensor, said controller operable to detect drift utilizing said sensor temperature signal.

2. A cooktop system according to claim 1 wherein to detect drift, said controller is operable to determine whether said temperature sensor is stable.

3. A cooktop system according to claim 2 wherein said controller determines whether said temperature sensor is stable by determining whether said temperature signal has been within a predetermined range for a predetermined period of time.

4. A cooktop system according to claim 1 wherein to detect drift, said controller is operable to determine room temperature and to compare said temperature signal with said determined room temperature.

5. A cooktop system according to claim 1 further comprising a control interface coupled to said controller, said interface comprising a selection unit for operator selection of a power level setting for said heater, said controller configured to switch off supply of power to said heater if a second power level selection for said heater is a lower power level than a first power level selection.

6. A cooktop system according to claim 5 wherein said controller is further configured to switch on supply of power to said heater once a sensed temperature is at least equal to a temperature corresponding to said second power level.

7. A cooktop system according to claim 5 wherein said controller is further configured to switch on supply of power to said heater once a sensed temperature is at least equal to a temperature corresponding to said second power level or once a predetermined period of time has elapsed from switching off supply of power.

8. A cooktop system according to claim 1 wherein said controller comprises a processor and a memory, said processor coupled to said memory and operable under control of a program stored in said memory.

9. A cooktop system comprising:

at least one cooktop heater, a controller coupled to said heater and operable to control supply of power to said heater; and a control interface coupled to said controller, said interface comprising a selection unit for operator selection of a power level setting for said heater, said controller configured to switch off supply of power to said heater if a second power level selection for said heater is a lower power level than a first power level selection, and said controller configured to detect drift of the cooktop system by using a temperature representative signal of the cooktop system.

10. A cooktop system according to claim 9 wherein said controller switches off power to said heater if said heater has stabilized at said first power level.

11. A cooktop system according to claim 9 wherein said controller is further configured to switch on supply of power to said heater once a sensed temperature is at least equal to a temperature corresponding to said second power level.

12. A cooktop system according to claim 9 wherein said controller is further configured to switch on supply of power to said heater once a sensed temperature is at least equal to a temperature corresponding to said second power level or once a predetermined period of time has elapsed from switching off supply of power.

13. A method for controlling operation of a heater, said method comprising the step of:

supplying power to the heater to maintain the heater at a first power level;

upon receipt of a command to reduce the power from the first power level to a second power level, switching off supply of power to the heater; and detecting drill of the heater by utilizing a temperature representative signal of the heater.

14. A method according to claim 13 wherein supply of power to the heater is switched off if said heater has stabilized at the first power level.

15. A method according to claim 13 further comprising the step of switching on supply of power to the heater once the heater temperature is at least equal to a temperature corresponding to the second power level.

16. A method according to claim 13 further comprising the step of switching on supply of power to the heater once the heater temperature is at least equal to a temperature corresponding to the second power level or upon expiration of a predetermined period of time.

17. A method for detecting drift of a cooktop including at least one heater and at least one temperature sensor associated with the heater, said method comprising the step of:

determining whether the temperature sensor is stable;

upon determining that the sensor is stable, determining a room temperature; and determining whether a temperature representative signal from the temperature sensor has drifted below a preset amount from the determined room temperature.

18. A method according to claim 17 wherein to determine whether the temperature sensor is stable, said method comprises the step of determining whether a temperature representative signal from the sensor has been within a predetermined range for a predetermined period of time.

19. A controller for coupling to a heater of a cooktop, said controller comprising a processor operable to:

switch on supply of power to the beater upon receipt of a first command to energize the heater according to a first temperature or power selection; and switch off supply of power to the heater upon receipt of a second command to deenergize the heater according to a second temperature or power selection; and detect drift of the cooktop by utilizing a temperature representative signal of the cooktop.

20. A controller according to claim 19 configured to switch off power to the heater upon receipt of said second command if the heater has stabilized at said first temperature or power selection.

21. A controller according to claim 19 configured to switch on supply of power to the heater once the heater temperature is at least equal to said second temperature selection or power selection.

22. A controller according to claim 19 comprising a processor and a memory, said processor coupled to said memory and operable under control of a program stored in said memory.

23. A controller according to claim 19 further configured to switch on supply of power to the heater once a sensed temperature is at least equal to a temperature corresponding to the second power level or once a predetermined period of time has elapsed from switching off supply of power.

24. A controller according to claim 19 further configured to detect drift.

* * * * *

UNITED STATES PATENT AND TRADEMARK OFFICE

CERTIFICATE OF CORRECTION

PATENT NO. : 6,717,117 B2
DATED : April 6, 2004
INVENTOR(S) : Blanchard et al.

It is certified that error appears in the above-identified patent and that said Letters Patent is hereby corrected as shown below:

Title page,
Item [75], Inventors, delete "Louisville" and insert therefor -- Shepherdsville --; after "A." and insert -- Alan --; and delete "Louisville, KY" and insert therefor -- Overland Park, KS --.

Column 10,
Line 35, delete "drill" and insert therefor -- drift --.

Signed and Sealed this

Tenth Day of August, 2004

JON W. DUDAS
*Acting Director of the United States Patent and Trademark Office*